US006649220B1

(12) United States Patent
Krueger et al.

(10) Patent No.: US 6,649,220 B1
(45) **Date of Patent: *Nov. 18, 2003**

(54) COMPLIANCE MECHANISM

(76) Inventors: Wallace F. Krueger, 4401 Merriweather Rd., Toledo, OH (US) 43623; David L. Dehn, 633 Appoline Ct., Rochester, MI (US) 48307

( * ) Notice: Subject to any disclaimer, the term of this patent is extended or adjusted under 35 U.S.C. 154(b) by 0 days.

This patent is subject to a terminal disclaimer.

(21) Appl. No.: 09/787,049

(22) PCT Filed: Oct. 12, 1999

(86) PCT No.: PCT/US99/22950

§ 371 (c)(1),
(2), (4) Date: May 14, 2001

(87) PCT Pub. No.: WO00/21684

PCT Pub. Date: Apr. 20, 2000

Related U.S. Application Data

(60) Provisional application No. 60/104,259, filed on Oct. 14, 1998.

(51) Int. Cl.[7] ..... B05C 1/06

(52) U.S. Cl. ..... 427/429; 118/256; 118/410; 118/429; 118/323

(58) Field of Search ..... 118/679, 680, 118/681, 683, 684, 410, 429, 323, 256; 901/11, 10, 22, 43, 45; 74/973.11; 427/425, 8, 9, 10, 429

(56) References Cited

U.S. PATENT DOCUMENTS

| | | | | |
|---|---|---|---|---|
| 3,792,782 A | | 2/1974 | Melton | |
| 4,645,408 A | | 2/1987 | Mizuno | |
| 5,131,349 A | * | 7/1992 | Keller et al. | 118/73 |
| RE34,197 E | | 3/1993 | Engel | |
| 5,298,072 A | * | 3/1994 | Schiele et al. | 118/681 |
| 5,312,212 A | | 5/1994 | Naumec | |
| 5,454,869 A | * | 10/1995 | Roden | 118/254 |
| 6,001,181 A | | 12/1999 | Bullen | |
| 6,132,809 A | * | 10/2000 | Hynes et al. | 427/421 |
| 6,471,774 B1 | * | 10/2002 | Krueger | 118/264 |

OTHER PUBLICATIONS

Machinery Handbook Revised 21st Edition, 1979, Industrial Press Inc., 604–661.*

International Search Report of PCT/US99/22950 corresponding to this patent application.

* cited by examiner

*Primary Examiner*—Richard Crispino
*Assistant Examiner*—George R. Koch, III
(74) *Attorney, Agent, or Firm*—Emch, Schaffer, Schaub & Porcello Co., L.P.A.

(57) ABSTRACT

A compliance mechanism (10) is disclosed for maintaining a fluid applicator (47) in contact with the surface of object (71) for fluid application. The compliance mechanism includes an L-shaped bracket (15) having a first leg (17) and a second leg (19), each leg having a tab. A first dual acting fluid operated cylinder (32) is slidably positioned on the first leg (17) of the L-shaped bracket (15). First cylinder (32) has a piston rod that advances during fluid actuation of the first cylinder. A second dual acting fluid operated cylinder (35) is slidably positioned on the second leg (19) of the L-shaped bracket (15). The second cylinder (35) has piston rod that advances during fluid actuation of the second cylinder (35). A fluid applicator (47) is on first cylinder (32) for applying fluid to object (71). The first cylinder (32) allows fluid applicator (47) to move relative to the object in a second direction whereby fluid applicator (47) is maintained in contact with object (71) during fluid application.

42 Claims, 9 Drawing Sheets

COMPLIANCE MECHANISM

This application is a 371 of PCT/US99/22950 field Oct. 12,1999 which claims the benefit of Provisional application No. 60/104,259 filed on Oct. 14, 1998.

FIELD OF THE INVENTION

The present invention is directed to a compliance mechanism that is used to maintain a fluid applicator in contact with the surface of an object to which a fluid is being applied. More particularly, the compliance mechanism is constructed so that the fluid applicator will remain in contact with the surface of the object during relative movement between the object and the fluid applicator. In addition, the compliance mechanism allows the fluid applicator to accommodate changes in the shape of the object without losing contact with the object during the fluid application process.

One of the primary applications of the compliance mechanism is the automotive glass industry where the fluid applicator is used to apply various fluids to the edge of the windshield, lights, and back window. The compliance mechanism will be generally described with regard to this particular automotive application. However, it should be understood that this invention is also suitable for a wide range of other fluid applications. The automotive glass application is only one use and is not meant to limit the scope of the applications for the invention.

DESCRIPTION OF THE PRIOR ART

The invention is particularly adapted for the production of glazing units or window assemblies for automotive vehicles, although it will find utility generally in a great many other fields. Installation of fixed window units in earlier automotive vehicles generally involved manual installation of the glazing unit using suitable mechanical fasteners such as metal clips for securing the unit in the vehicle body, applying sealant around the marginal edges of the glazing unit, and positioning decorative trip strips around the unit to cover the junction between the marginal edges of the glazing unit and the adjacent portions of the vehicle body. Assembly and installation of such units was relatively slow and costly inasmuch as a considerable amount of labor was required. The procedure was not readily adaptable to being speeded up to accommodate increased automobile production line rates, nor was it adapted to being automated.

Efforts to overcome these disadvantages resulted in numerous improved window structures. Thus, unitary window assemblies were developed wherein a sheet of glass was provided with an adjacent peripheral frame, with a gasket of molded material extending between the frame and the peripheral margin of the window to hold the glass sheet within the frame. Fasteners provided at spaced locations along the frame permitted the entire assembly to be guided into position over an appropriate opening in a vehicle and secured to the vehicle as a unit. Such unitary window units reduce the time required and simplify installation in the vehicle opening. However, due to the labor required in manually assembling the frame and gasket on the sheet of glass, the structures are relatively costly.

More recently, in order to eliminate the manual assembly, so-called encapsulated grazing units have been developed wherein individual sheets of glass or laminated glass units are formed with integral frame or gasket members molded and cured in situ by a reaction injection molding (RIM) process. One such process and resulting product is shown and described in U.S. Pat. No. 4,561,625 to Weaver. Such encapsulating glazing units can be fabricated with a minimum of hand labor, and the resulting units can be readily attached to the portions of the vehicle body defining the window openings during assembly of the vehicle.

As described in the aforementioned patent, such encapsulated units are fabricated by disposing a predetermined portion of the marginal periphery of a sheet of transparent material within a mold structure. A polymeric gasket forming material is injected into the mold cavity and cured in situ on the sheet to encapsulate the marginal peripheral edge portion of the sheet. The resulting assembly can then be readily attached to the body portion defining the periphery of a window opening during manufacture and assembly of a vehicle.

Due to the nature of the glass surfaces, it is known that the gasket materials may not form a permanent, long term bond directly to the glass. Thus, they may not maintain adhesion to the glass surface for a length of time consistent with the life of the automobile. Exposure to weather moisture and sunlight, as well as other factors, may cause the gasket material to loosen from the glass with the passage of time, and ultimately to separate entirely from the glass. In order to improve the adherence of the gasket material to the glass and increase the service life of the encapsulated units to an acceptable level, it has been common practice to apply a coating of a liquid primer material to the affected surface of the glass prior to formation of the gasket thereon. Heretofore, this has been accomplished as by manually painting a band of the primer material along the appropriate edge portion of the glass panel. Such a procedure may, for example, utilize a brush periodically dipped in a container of the primer material, or a plastic squeeze bottle containing the primer material and having a suitable dispensing tip. In any event, the procedures are not entirely satisfactory in that they are time-consuming, labor-intensive and may not result in a satisfactory coating of the primer material. Thus the primer layer, which is generally a urethane material, should be applied as a uniform, continuous, relatively thin band in order to function properly. Should the layer be of excessive thickness, it may separate within the layer along a cleavage plane, resulting in failure of the bond. Of course, if the layer is not of sufficient thickness or if certain areas are not coated, the primer layer would likewise be ineffective for its intended purpose. The primer, and particularly the solvent therefore, may be toxic in nature so that manual application thereof, particularly when using an open container of the primer, may require use of protective equipment by the workers. Such manual application processes also generally result in waste of the primer material and generally messy conditions in the work place. Due to the difficulty in controlling the width of manually applied bands, it may also be necessary to mask the work piece prior to application of the primer material.

The term "compliance" has been applied to the interface between a tool and the product that the tool is designed to act upon. A programmed robot or other motion device can be used to define a travel path that coincides with the perimeter or across a product. One primary application involves the deposition of primers, paint, and activators, adhesives, etc. to aid in the attachment of foam tapes, plastic moldings, metal components such as hinges, locks and all types of encapsulated products. In the process of applying a liquid primer to a defined surface it is desirable to have resiliency between the primer depositing pad or brush and the coated product. The soft touch and feather-like contact (resembling the fine touch of an artist) is the ideal result to give the designed coverage, exact line demarcation and long applicator life. The invention has the capability of being mounted on the robot arm, the arm of a work station module or on a stationary gantry type device that moves the product to be coated to give the desired coverage. The compliance unit of this design, provides the tracking resilience that is required in many robotic applications. Such tracking is virtually impossible to achieve with a robot because of the variable curvatures of the products and the almost impossibility of programming a robot to exacting dimensions on a non-uniform product.

Attempts have been made to automate the application of the primer material to the edge of a glass surface. U.S. Pat. No. 5,131,349 shows one method for automating the application of the primer material. However, the glass surfaces, especially in automotive applications, frequently change in contour and shape, and it is difficult to maintain the fluid applicator described in the '349 patent in contact with the glass surfaces. It is also difficult to maintain a very light contact pressure between the fluid applicator and the glass surfaces so that a desired thickness of primer is uniformly applied.

Thus, there is a need in the industry for a compliance mechanism that can maintain contact with a surface that changes in contour and shape. There is also a need for a compliance mechanism that maintains a light contact pressure with the surface of the object that is to be primed or coated. There is also a need in the industry for a compliance mechanism that can apply a primer or coating at a desired thickness in a uniform manner.

SUMMARY OF THE INVENTION

This invention consists of a compliance device that is used to apply a liquid to a product, primarily glass, in a precision lay down pattern, utilizing specialized and unique flow applicator tips. Some of the 20 applicator tip designs have been documented in U.S. Pat. No. 5,131,349.

In the process to apply primers, adhesives, promoters, etc. to automotive glass and like application, it is necessary to maneuver the specialized tip applicators into many angular modes to provide constant regulated pressure contract with the glass. It is also necessary to maintain band width coverage on all designated surfaces and at the same time control the mill thickness of the fluid that is applied to meet the required quality standards.

There are many applications where the design of the product demands a non-uniform and constant changing band width on one or two edges or on one or both sides of the light and/or a mixture of these variables on a single piece of glass. To accomplish such requirements, it is frequently necessary to employ two different applicator tip designs. On one portion of the product, it may be necessary to have a vertical placement of the applicator tip with respect to the product. On another section of the product, it may be necessary to use the applicator tip in a horizontal mode. Many design factors of the product dictate the ability or inability to perform the required liquid lay down in one cycle.

The capability to perform this type of complex pattern for liquid lay down in a rapid, single automatic cycle has been accomplished with the design of the compliance mechanism that can rotate within its mounting to position the fluid dispenser in either a vertical or horizontal position or an angular position between vertical and horizontal.

A compliance mechanism is disclosed for maintaining a fluid applicator in contact with the surface of an object to which a fluid is being applied. The compliance mechanism includes an L-shaped bracket having a first leg and a second leg. A first tab is positioned at the end of the first leg and a second tab positioned at the end of the second leg. A first dual acting fluid operated cylinder is slidably positioned on the first leg of the L-shaped bracket. The first cylinder has a piston rod that extends from the first cylinder and the fluid actuation of the cylinder causes the piston rod to be advanced relative to the first cylinder. The end of the piston rod that extends from the first cylinder is secured to the first tab. A second dual acting fluid operated cylinder is slidably positioned on the second leg of the L-shaped bracket. The second cylinder has a piston rod that extends from the second cylinder and the fluid actuation of the cylinder causes the piston rod to be advanced relative to the second cylinder. The end of the piston rod that extends from the second cylinder is secured to the second tab. A fluid applicator is positioned on the first cylinder for applying a fluid to the object. The first cylinder allows the fluid applicator to move relative to the object in first direction and the second cylinder allowing the fluid applicator to move relative to the object in a second direction whereby the fluid applicator is maintained in contact with the object during the application of the fluid to the object.

It must be pointed out that the compliance mechanism and the associate fluid dispenser and applicator tip can be mounted on the end of a robot arm to apply a fluid by advancing the applicator tip with the robot arm over the stationery glass product. It is also possible to move the glass product relative to the applicator tip during the fluid application process.

Other objects and advantages of the present invention will become apparent to those skilled in the art upon a review of the following detailed description of the preferred embodiments and the accompanying drawings.

DETAILED DESCRIPTION OF THE PREFERRED EMBODIMENT(S)

Figure 3:
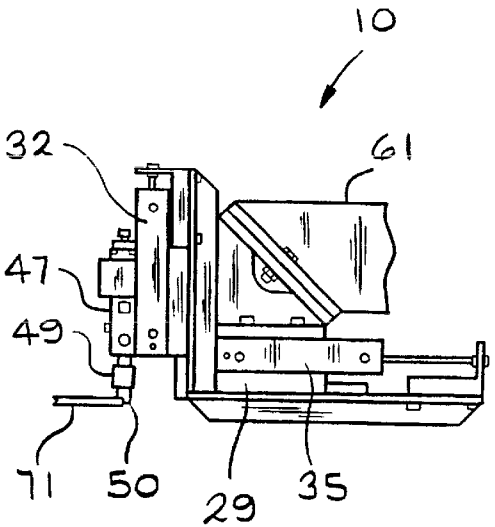
FIG. 3 is a side elevation view of the compliance mechanism of the invention.

The invention relates to a compliance mechanism that can be utilized to apply a fluid layer to an object. More particularly, the compliance mechanism has the ability to accommodate motion in two directions and has a very light touch. The features of the invention will be more readily understood by referring to the attached drawings in combination with the following description of the invention.

The compliance mechanism 10 shown in FIGS. 1–7 has an L-shaped bracket 15 having a first leg 17 and a second leg 19. The first and second legs 17 and 19 are positioned substantially perpendicular to one another. A first reinforcing member 21 is secured to the first leg 17 and to a portion 22 of the second leg 19 which is adjacent to the first leg 17. The first reinforcing member 21 provides additional support and rigidity for the first leg 17. A second reinforcing member 25 is secured to the second leg 19 and provides additional rigidity and support for the second leg 19. A first slide mechanism 29, such as a linear ball, bearing is positioned on the first leg 17 on the side of the leg that is opposite to the first reinforcing member 21. A second slide mechanism 30 is positioned on the second leg 19 on the side that is opposite the second reinforcing member 25. A first fluid operated cylinder 32 is secured to the first slide mechanism 29 on the first leg 17. A second fluid operated cylinder 35 is secured to the second slide mechanism 30 positioned on the second leg 19. The first and second fluid operated cylinders 32 and 35 are dual acting cylinders with fluid supply ports 37 located at each end of the cylinders. In practice, it has been found preferable to use low friction fluid operated cylinders for the compliance mechanism. In particular, glass lined low friction fluid operated cylinders have been found to work particularly well. However, other types of low friction cylinders can also be utilized. The fluid supply ports 37 are disposed for supplying fluid to either side of the piston (not shown) located in the interior of the cylinders. A piston rod 39 is connected to each piston and extends from a first end of the cylinders. The piston rod 39 of the first fluid operated cylinder 32 is secured to a first bracket 41 that extends from the first leg 17 in a direction substantially perpendicular to the first leg 17. The first bracket 41 extends from the side of the first leg 17 that is opposite to the first reinforcing member 21. The first bracket 41 is also disposed to be substantially parallel to the second leg 19. The piston rod 39 for the second fluid operated cylinder 35 is secured to a second bracket 43 that extends from the second leg 19. The second bracket 43 extends from the second leg 19 in a direction that is substantially perpendicular to the second leg 19. The second bracket 43 extends from the side of the second leg 19 that is opposite to the second reinforcing member 25. The second bracket 43 is disposed to be substantially parallel to the first leg 17. A protective cover or shield (not shown) can be positioned over the first and second fluid operated cylinders 32, 35 and the rods for these cylinders. The cover or shield is designed to protect the cylinders from the operating environment for the compliance mechanism.

Figure 7:
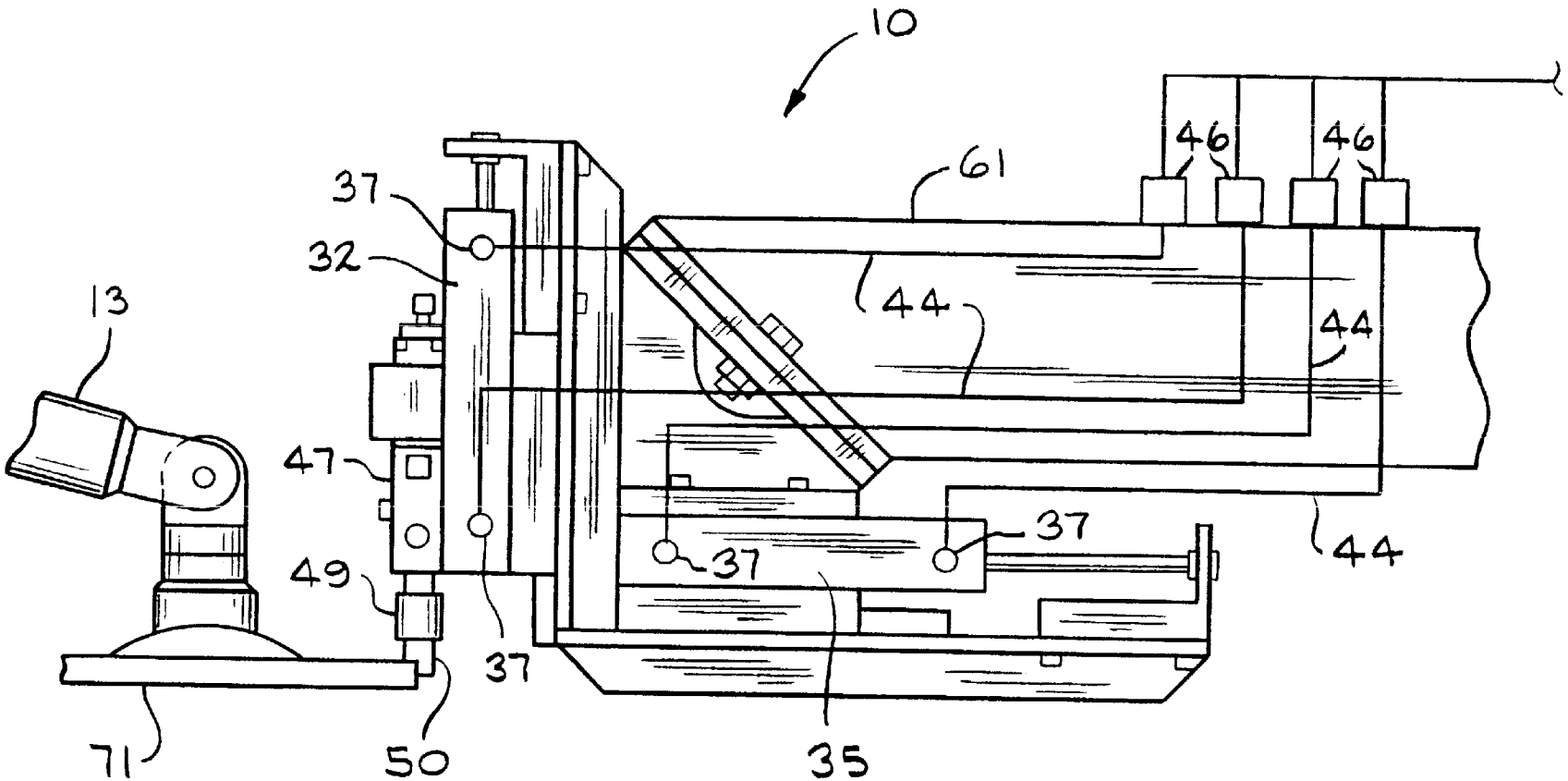
FIG. 7 is a side elevation view of the compliance mechanism of the invention.

As shown in FIG. 7, the first and second fluid operated cylinders 32, 35 are supplied with fluid to actuate the cylinders through supply lines 44. Each supply line 44 is connected to a at least one self-exhausting regulator 46. The supply lines 44 extend from the regulators 46 and are connected to one of the fluid supply ports 37 on the first and second fluid operated cylinders 32 and 35. The regulators 46 act to reduce pressure build up in the first and second fluid operated cylinders 32 and 35 so that the force necessary to advance the piston rod 39 in the cylinders does not change over the distance of travel for the rod. An example of a self-exhausting regulator 46 that can be used is the Series VEX1 regulators sold by SMC Corp.

A fluid dispenser 47 having a fluid applicator tip 49 is secured to the first fluid operated cylinder 32. An example of a fluid dispenser that can be used is the Model 5000 fluid dispenser sold by Designetics. The fluid dispenser 47 is positioned on the first fluid operated cylinder 32 so that the fluid applicator tip 49 extends beyond a second end of the first fluid operated cylinder 32. The fluid applicator tip 49 usually extends beyond the second end of the first fluid operated cylinder 32 that is opposite to the first end where the piston rod 39 extends from the cylinder 32. The fluid applicator tip 49 is constructed to have a guide flange 50 that engages an edge of the object 71 that is to be coated with fluid to position the fluid applicator tip 49 with respect to the object 71. The fluid applicator tip 49 usually contacts at least one other surface of the object. The applicator tip 49 usually has a fell or foam pad that applies the fluid to the object that is to be coated. The applicator tip 49 applied fluid to the object in a manner well known in this field. Examples of applicator tips 49 that can be used with this invention are Part Numbers Series 11 through Series 67 sold by Designetics.

In some applications the applicator tip 49 may not have guide flange 50 to position the applicator tip with respect to the object 71. In this situation, the applicator tip 49 will have to be placed very precisely with respect to the object 71 so that the fluid layer is applied to the desired area. Since the applicator tip 49 only engages one surface of the object, the compliance mechanism 10 will only be able to effectively accommodate relative movement between the applicator tip 49 and the object 71 in one direction. In this application, it is only necessary to have the fluid operated cylinder that controls motion in the one selected direction be operational. Usually, the fluid operated cylinder that does not control motion in the desired direction would be effectively locked to prevent motion in a direction that is not controlled by the position of the applicator tip 49.

The second fluid operated cylinder 35 is secured to a bar 53. A flange 55 is secured to and extends from the bar 53. The end of the flange 55 that is spaced apart from the bar 53 is disposed at an angle with respect to the bar 53 and a positioning plate 57 is secured to this end of the flange 55. The positioning plate 57 is also disposed at an angle with respect to the bar 53. The positioning plate 57 is releasably secured to a positioning member 59 that is connected to a support arm 61. The positioning member 59 is disposed at the same angle with respect to the support arm 61 that the positioning plate 57 is disposed at with respect to the flange 55. A releasable securing means 63 such as a bolt 65 and a nut 67 is used to releasably secure the positioning plate 57 to the positioning member 59. In practice, it has been found to be preferable that the positioning member 59 and positioning plate 57 be disposed at a 45° angle.

Figure 2:
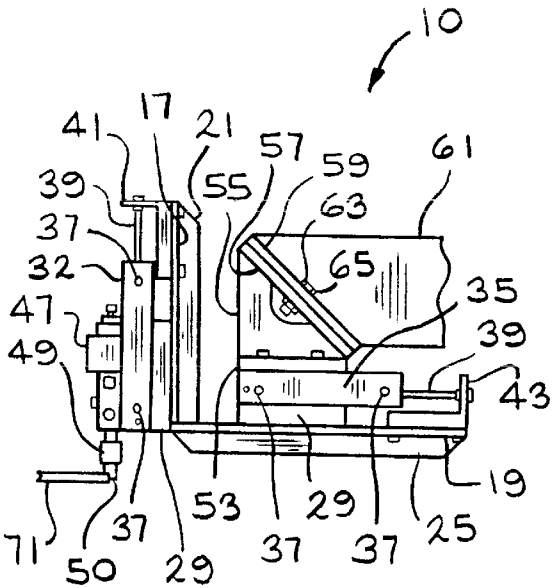
FIG. 2 is a side elevation view of the compliance mechanism of the invention.
Figure 1:
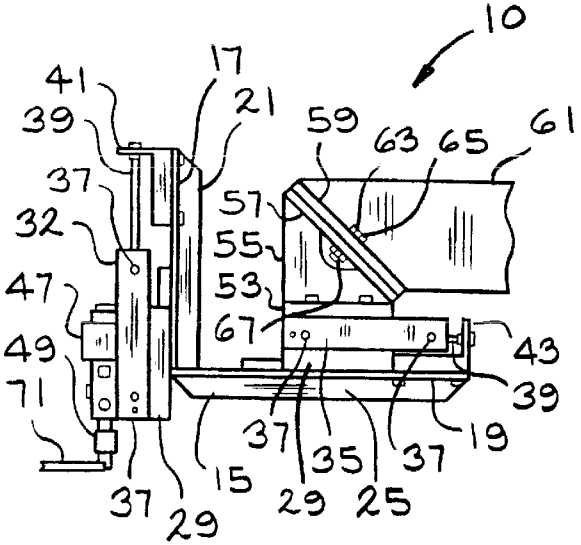
FIG. 1 is a side elevation view of the compliance mechanism of the invention.
Figure 6:
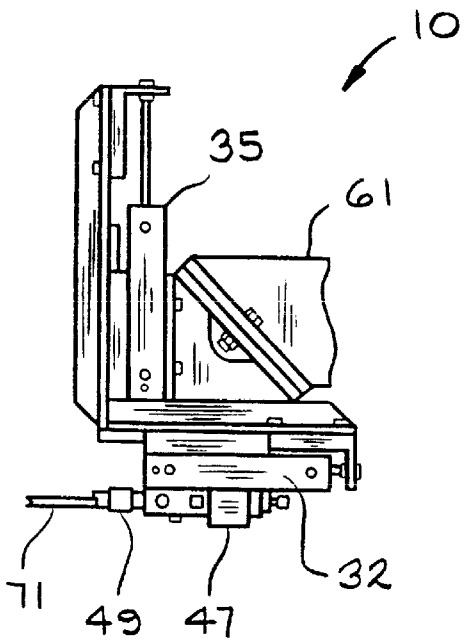
FIG. 6 is a side elevation view of the compliance mechanism of the invention.
Figure 5:
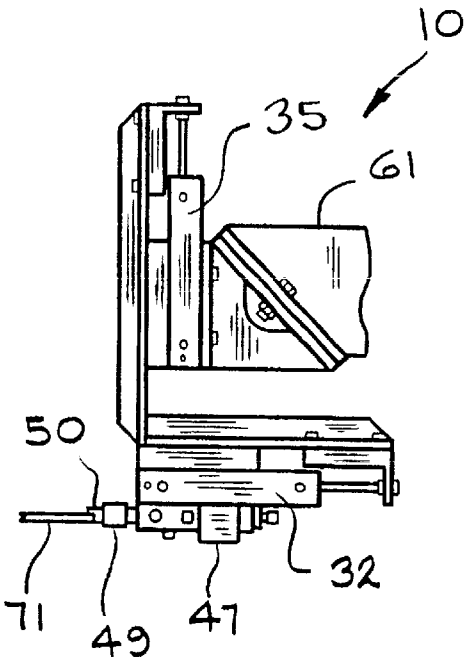
FIG. 5 is a side elevation view of the compliance mechanism of the invention.
Figure 4:
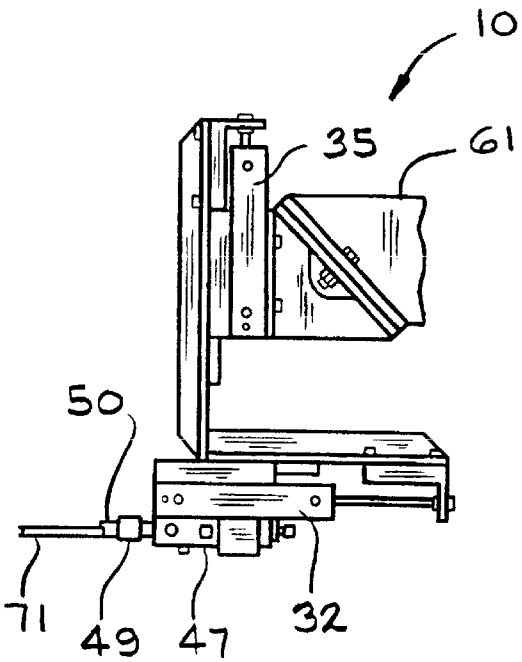
FIG. 4 is a side elevation view of the compliance mechanism of the invention.

FIGS. 1–3 show the compliance mechanism 10 with the fluid dispenser positioned in a vertical orientation. FIGS. 4–6 show the compliance mechanism 10 with the fluid dispenser positioned in a horizontal orientation. It should be understood that the fluid dispenser will work satisfactorily in either orientation or in any position between these two orientations.

In operation, the compliance mechanism 10 is utilized to place a fluid layer or strip on an object that is positioned adjacent the compliance mechanism. Usually, the object is moved with respect to the compliance mechanism during the fluid application process. However, it is also possible for the compliance mechanism to be moved relative to the object during the coating process.

To begin the coating process, the compliance mechanism 10 is positioned in the configuration shown in FIG. 1 which is a biased position for the compliance mechanism. In the position shown in FIG. 1, the first fluid operated cylinder 32 is positioned at the end of the length of stroke for the cylinders and the second fluid operated cylinder 35 is positioned in the fully retracted position for the cylinder. This places the applicator tip 49 at a location that is spaced apart from the support arm 61 and allows the first and second fluid operated cylinders to utilize their full range of motion when engaging an object for coating. This is accomplished by supplying fluid to the fluid supply ports 37 on each side of the piston (not shown) located in the cylinder 32 so that the piston 39 is advanced to substantially its fully extended position for the first cylinder and the piston is advanced to its fully retracted position for the second cylinder. The first and second fluid operated cylinders 32 and 35 are low friction cylinders and only a very small force is required to operate or move the piston in the cylinders. The piston rod 39 that is connected to the piston in the first fluid operated cylinder 32 is connected to the first tab 41 that extends from the first leg 17. As the piston is advanced in the first fluid operated cylinder 32, the piston rod 39 will be caused to extend or retract into the first fluid operated cylinder 32 by the movement of the piston. Since the piston rod 39 is connected to the first tab 41, this causes the first fluid operated cylinder 32 to be advanced with respect to the first leg 17. Since the first fluid operated cylinder 32 is mounted on the slide mechanism 29 that has very little resistance to movement, it is very easy to advance the first fluid operated cylinder with respect to the first leg 17. The second fluid operated cylinder 35 is supplied with fluid through the fluid supply ports 37 in the manner just described for the first fluid operated cylinder 32 and as described above, it only requires a very small force to advance the piston (not shown).

Once the first fluid operated cylinder 32 and the second fluid operated cylinder 35 are positioned as shown in FIG. 1, the weight of the fluid dispenser 47 and the fluid pressure for the fluid supplied to the fluid supply ports 37 will essentially control the resistance to movement for the first and second fluid operated cylinders. When the object 71 is positioned in contact with the fluid applicator tip 49 on the fluid dispenser 47, it is desirable to maintain the fluid applicator tip in contact with the object during the application process. In most applications, the object 71 has a change of shape, contour or there are irregularities in the object 71 that it is necessary for the fluid applicator tip 49 to move in both a horizontal and vertical direction to maintain contact with the object 71.

The fluid applicator can be supplied with a fluid supply system such as described in U.S. Pat. No. 5,131,349. The description of this fluid supply system described in U.S. Pat. No. 5,131,349 is hereby incorporated by reference into this patent application. However, it should be understood that other fluid supply systems could also be utilized with the present invention.

When the coating operation begins, the object 71 is brought into position adjacent the fluid applicator tip 49. The compliance mechanism will be brought into the position shown in FIG. 1 to be prepared to be engaged by the object. The object is then moved to engage the applicator tip 49. The object 71 causes the applicator tip 49 and fluid dispenser 47 to move to substantially the position shown in FIG. 2. This is the central or neutral position for the first and second fluid operated cylinders 32, 35. From the position shown in FIG. 2, the fluid applicator tip 49 can be advanced or retracted in two directions a relatively equal amount to accommodate changes presented by the object 71 during the fluid application process. The fluid supplied to the fluid supply ports 37 on the first and second fluid operated cylinder 32, 35 are balanced in a way so there is a slight bias on the cylinders in the direction toward the object 71. The amount of the bias can be controlled by the pressure differential of the fluid supplied to either side of the piston in the first fluid operated cylinder 32 and second fluid operated cylinder 35. The self-exhausting regulators 46 substantially eliminate pressure build-up in the first and second fluid operated cylinders 32, 35 during the operation of the cylinders. The regulators 46 assist in having the biasing, force maintained at substantially the desired level as the first and second fluid operated cylinders 32, 35 are caused to move during the operation of the compliance mechanism 10. In most applications, the biasing pressure differential is relatively small since a light biasing force is all that is necessary to properly position the fluid applicator tip. Also, it is important that the biasing force created by the pressure differential does not unduly restrict the ability of the first fluid operated cylinder 32 to move with respect to the object 71. The biasing force in the first and second cylinder can be set at different levels to accommodate particular processing parameters.

In practice, it has been found that a biasing force of from about one (1) ounces per square inch to about twenty five (25) ounces per square inch on the applicator tip 49 works well in keeping the applicator tip 49 in contact with the object that is being coated. It has been found especially preferable to utilize a biasing force from about four (4) ounces per square inch to about twelve (12) ounces per square inch to keep the applicator tip 49 in contact with the object that is being coated. This low biasing force creates a feather light touch that allows the applicator tip to work most effectively. The light contact between the applicator tip 49 and the object also prolongs the life to the applicator tip. However, it should be understood that the biasing force can vary from the above ranges for particular uses of the compliance mechanism. In the example of applying a coating fluid to an object, the nature of the object and the fluid that is being applied to the object will have a significant impact on establishing the biasing forces for the first and second fluid operated cylinders.

However, it should be appreciated that the fluid supplied to the first or second fluid operated cylinders 32, 35 can be increased to a level that will effectively lock the cylinder and prevent movement of the cylinder and the compliance mechanism in one or both directions. There are applications where it is desirable to lock the compliance mechanism in this manner to achieve a desired coating operation on a particular object. As an example, if the applicator tip 49 does not have an edge guide 50, it may be desirable to lock one of the cylinders to maintain the proper location for the applicator tip relative to the object. The cylinders can be locked during the entire coating operation or just during a portion of the overall coating operation.

When the object 71 is being coated by the fluid applicator tip 49, any movement away from the fluid applicator tip 49 in a vertical direction will result in the first fluid operated cylinder 32 moving toward the object 71 due to the biasing force in the first fluid operated cylinder. If the object 71 moves in a vertical direction toward the fluid applicator tip 49, the first fluid operated cylinder 32 will move in the same direction as the object 71 and keep the fluid applicator tip 49 in contact with the surface of the object 71. Since the biasing force in the first fluid operated cylinder 32 is relatively small, only a small amount of pressure is necessary to cause the fluid dispenser 47 and the first fluid operated cylinder 32 to move in response to the change in position of the object 71. The small biasing force in the first fluid operated cylinder 32 results in a very light touch or feel for the applicator tip 49 on the object 71. Since the first fluid operated cylinder 32 is a low friction cylinder and is mounted on the slide mechanism 29, there is almost no resistance to movement of the first fluid operated cylinder 32 other than the biasing force in this cylinder.

If the object 71 moves away from the second fluid operated cylinder 35, the biasing force in this cylinder will cause the second fluid operated cylinder 35 to move toward the object and keep the applicator tip 49 in contact with the object 71. If the object 71 moves in a direction toward the second fluid operated cylinder 35, it is only necessary to overcome the biasing force in this cylinder to cause the second fluid operated cylinder 35 to move with the object 71 and maintain the fluid applicator tip 49 in the desired position with respect to the object.

FIG. 1 and FIG. 3 show the range of motion for the fluid dispenser 47 in vertical and horizontal direction. In practice, it has been found that this range of motion is satisfactory to accommodate most objects 71 on which a fluid is applied.

In some applications, it may be necessary to have a stronger biasing force in the first fluid operated cylinder 32 and the second fluid operated cylinder 35 to maintain proper positioning for the fluid dispenser 47 to achieve the desired application of the fluid. If higher pressures are required, it is only necessary to adjust the fluid pressures in the first and second fluid operated cylinders 32, 35 to increase the resistance of movement in the cylinders and achieve the desired fluid applicator tip pressure on the object 71.

It is frequently necessary to change the angular position of the fluid dispenser 47 to apply a fluid in a desired manner to an object 71. To change the positioning of the fluid dispenser 47, it is only necessary to loosen the releasable securing means 63 and change the orientation of the positioning plate 57 with respect to the positioning member 59. As shown in FIGS. 4, 5 and 6, the positioning plate 57 has been rotated relative to the positioning member 59 so that the fluid dispenser 47 is now disposed in a horizontal orientation instead of the vertical orientation shown in FIGS. 1, 2 and 3. It is possible to locate the fluid dispenser 47 in other positions between the positions shown in FIGS. 1, 2 and 3 and the positions shown in FIGS. 4, 5 and 6. Once the desired position is obtained for the fluid dispenser 47, the releasable securing means 63 is tightened to maintain the positioning plate 57 in the desired position with respect to the positioning member 59.

The compliance mechanism as shown in FIG. 7 can be utilized on an automated system for applying fluid to an object. In this application, the compliance mechanism 10, fluid dispenser 47 and fluid applicator tip 49 are positioned on the arm 61. The arm 61 can be movable and be used to move the fluid dispenser 47 into position so that it is adjacent the object 71 on which the fluid is to be applied. The object 71 can be moved to the desired position for fluid application by the use of a robot 13 or other suitable positioning means. The robot 13 can be used to advance or rotate the object 71 with respect to the applicator tip 49 during the application of the fluid to the object.

Figure 8:
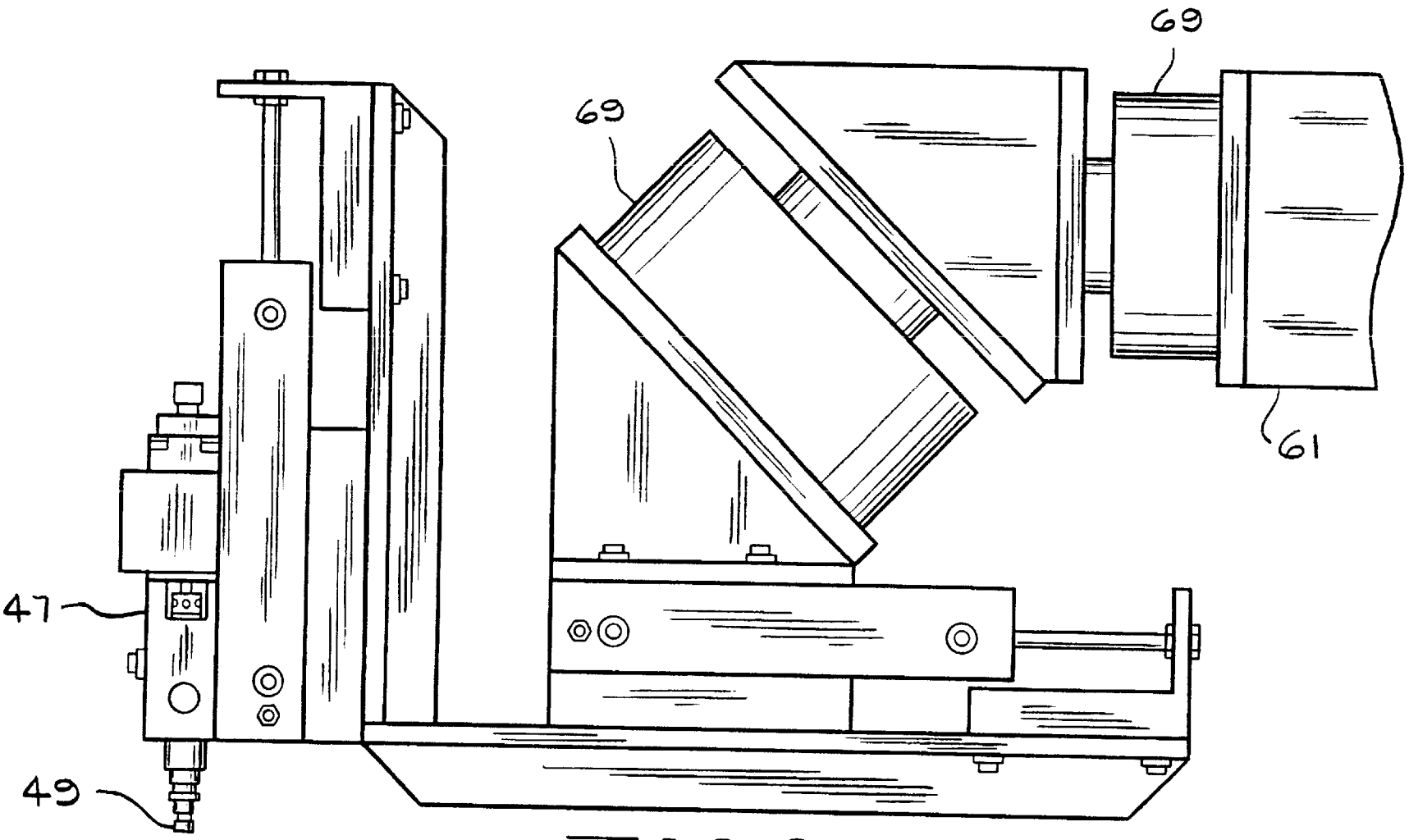
FIG. 8 is a side elevation view of another feature of the compliance mechanism invention.

As shown in FIG. 8, it is also possible to use one or more rotary actuators 69 to position the fluid dispenser 47 and fluid applicator tip 49 in the desired position. The rotary actuator 69 replaces the positioning member 59 previously described as a mechanism for angularly positioning the fluid dispenser 47. The rotary actuator 69 usually contains a motor or fluid actuated mechanism that rotates the rotary actuator to the desired position. A control means (not shown) can be used to select the desired position for the rotary actuator 69 and the first dispenser 47.

Figure 9:
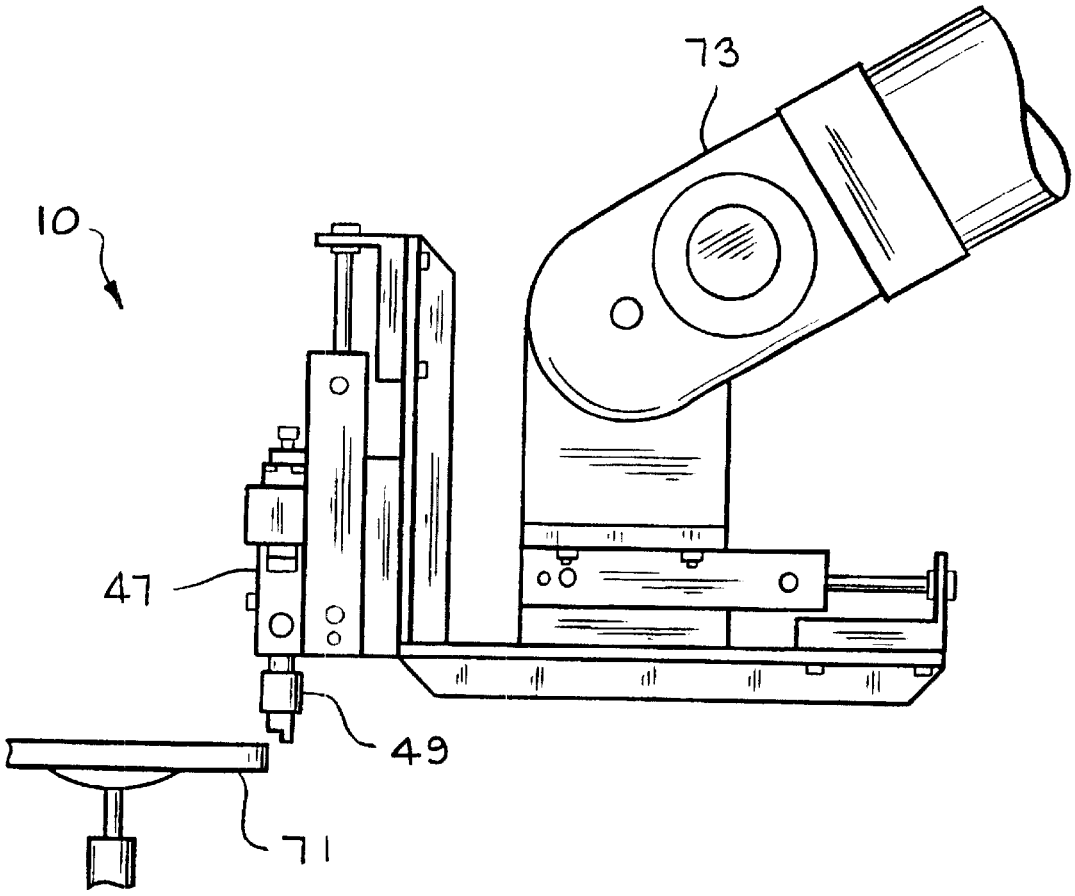
FIG. 9 is a side elevation view of another feature of the invention.

As shown in FIG. 9, the compliance mechanism 10, fluid dispenser 47 and fluid applicator tip 49 are positioned on or connected to a robot 73. The robot 73 is used to position the fluid dispenser 47 and fluid applicator tip 49 into position adjacent the object 71 on which the fluid is to be applied. The robot 73 can be used to advance the applicator tip 49 around the areas of the object that are to receive a layer of fluid. In this example, the object 71 is not usually moved during the application of the fluid layer by the applicator tip 49.

Figure 10:
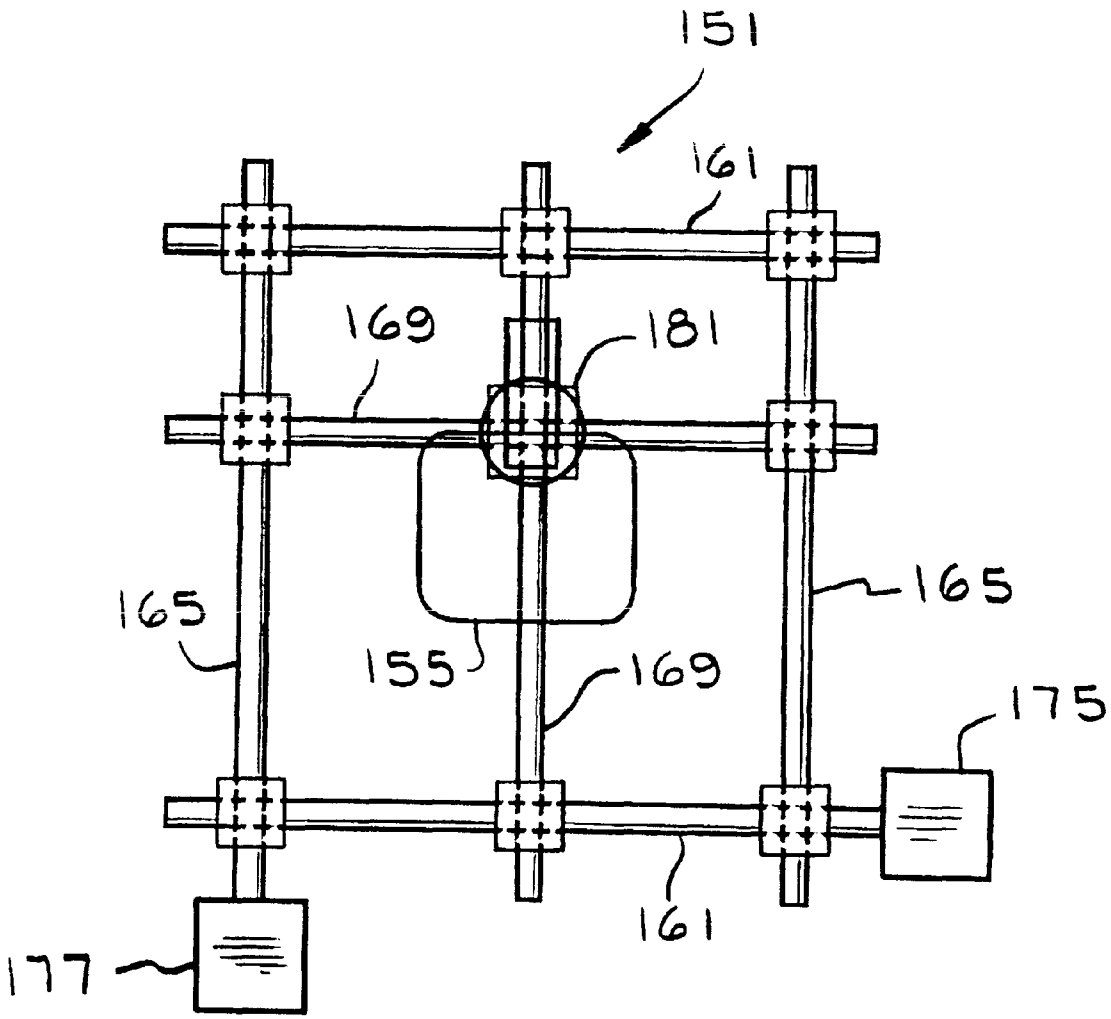
FIG. 10 is a plan view of another feature of the invention.
Figure 11:
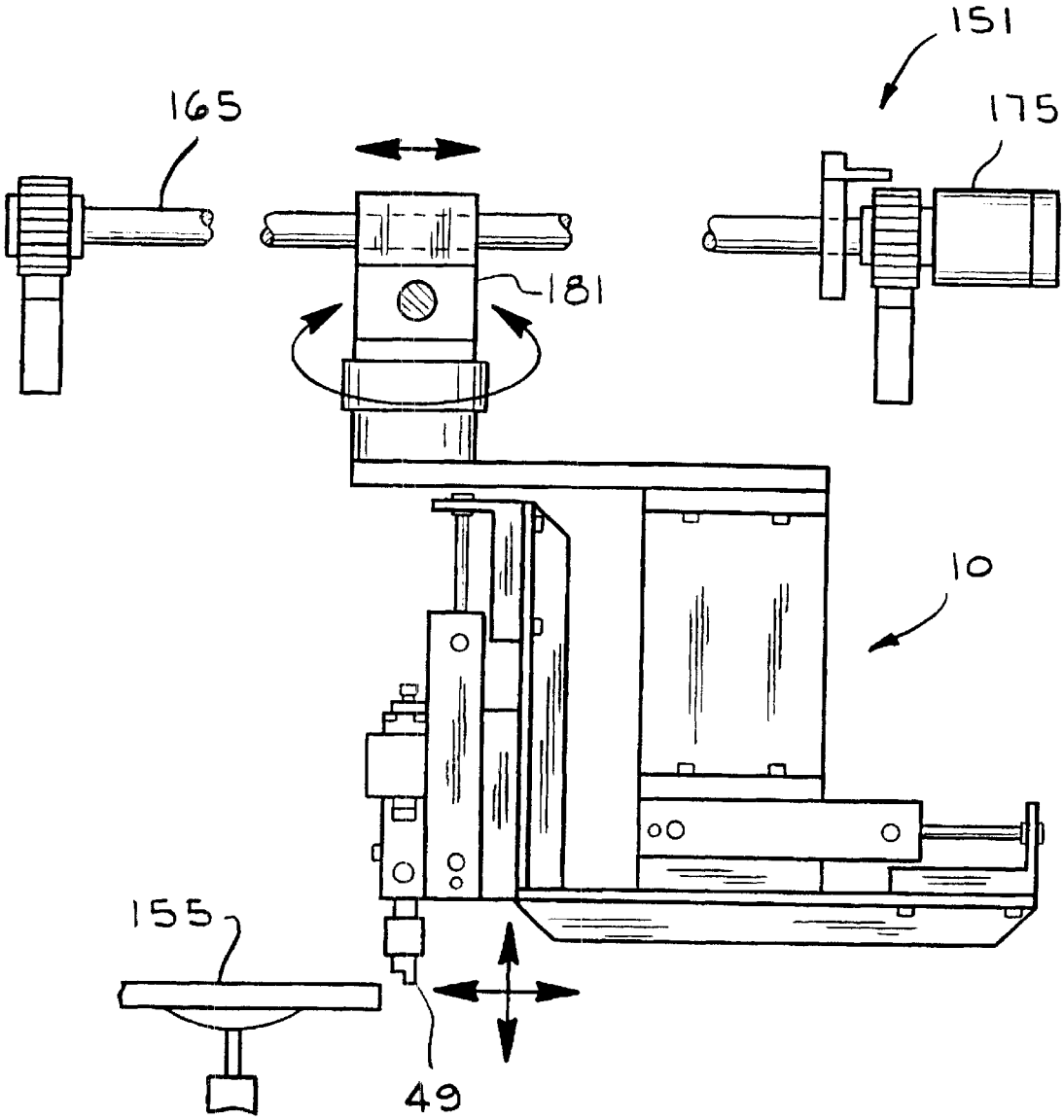
FIG. 11 is a side elevation view of the embodiment of FIG. 10.

As shown in FIGS. 10 and 11, the compliance mechanism 10 previously described can also be mounted on a moveable gantry 151 to properly position the applicator tip 49 with respect to an object 155 that is to be coated. The gantry 151 has opposed first guide rails 161 and opposed second guide rails 165. The first guide rails 161 are positioned in a substantially parallel relationship. The second guide rails 165 are also positioned in a substantially parallel relationship. The first guide rails 161 are disposed in a substantially perpendicular relationship to the second guide rails 165. A first driven member 167 is positioned in operative contact with the first guide rails 161. A suitable drive means 175 is connected to at least one of the first guide rails to cause the first driven member 167 to be advanced along the first guide rails 161. A second driven member 169 is positioned in operative contact with the second guide rails 165. A suitable drive means 177 is connected to at least one of the second guide rails to cause the second driven member 169 to be advanced along the second guide members 165. In most applications, the drive means 175 and 177 are substantially the same and act to index the driven members 167 and 169 along their respective guide rails 165 and 167. A mounting bracket 181 is slidably connected to the first driven member 167 and the second driven member 169 so that the mounting bracket 181 is free to move when said first and second driven members are caused to move by the drive means 175 and 177. As shown in FIG. 11, the compliance mechanism 10 is mounted on a side of the mounting bracket 181 that is spaced apart from the first and second driven members 167 and 169. By activation of the drive means 175 and 177, the first and second driven members 167 and 169 can be indexed or advanced to position the compliance mechanism 10, the fluid dispenser 47 and the applicator tip 49 in a desired location with respect to the object 155 that is to be coated. By proper operation of the gantry 151, the applicator tip 49 can be advanced around the object 155 until the desired coating is applied. The compliance mechanism 10, the fluid dispenser 47 and the applicator tip 49 all function in the manner previously described.

Figure 12:
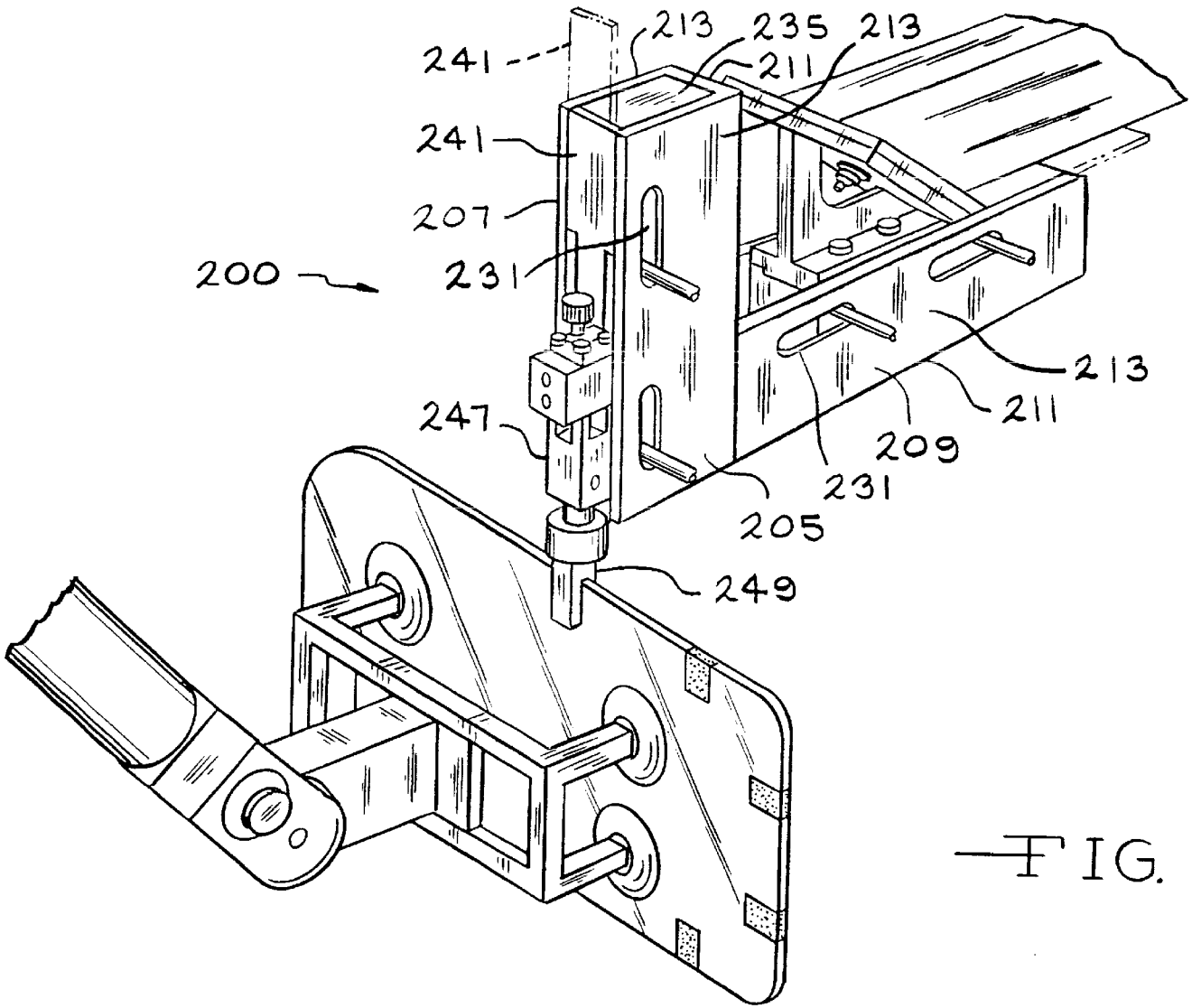
FIG. 12 is a perspective view of another feature of the compliance mechanism.
Figure 13:
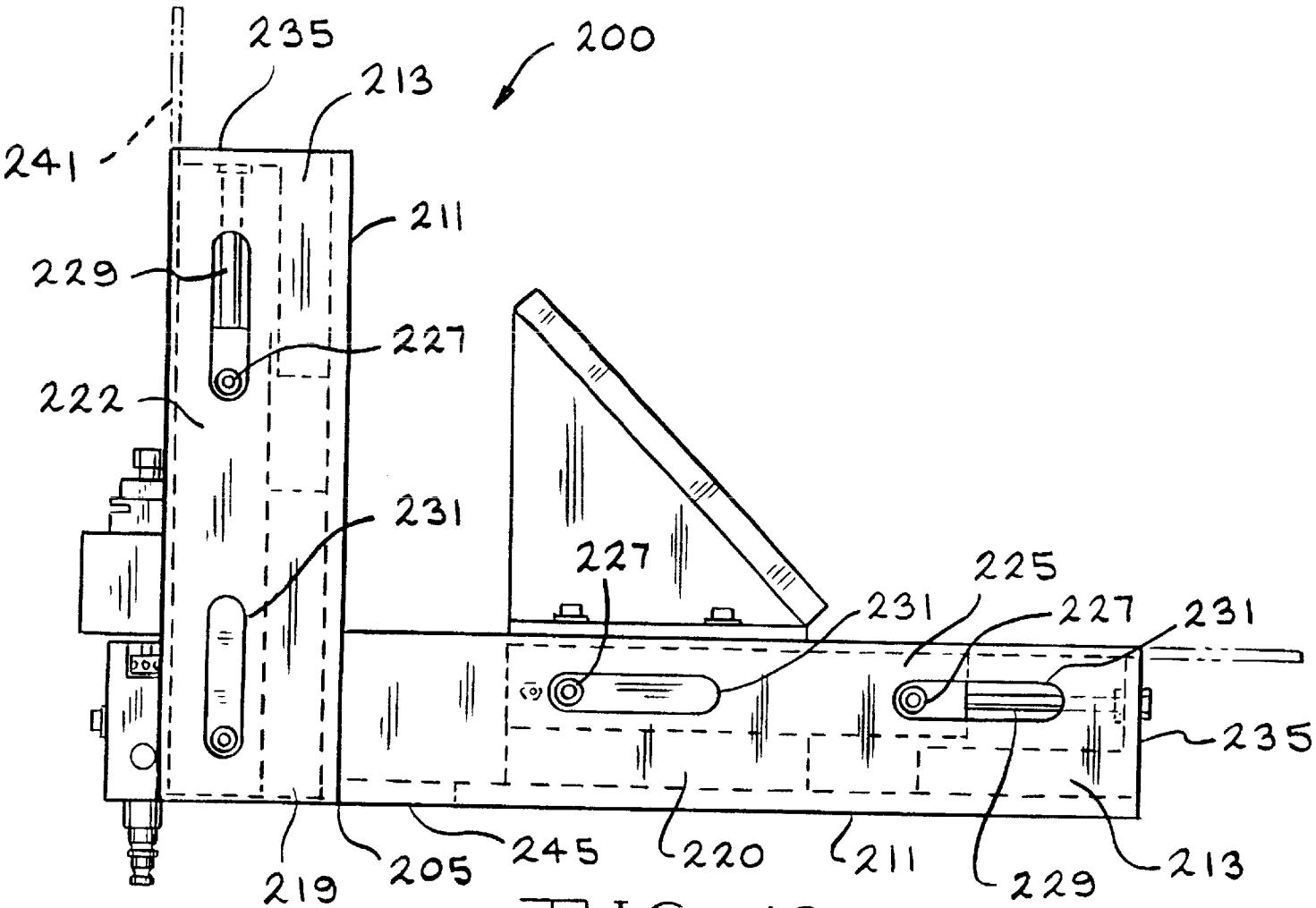
FIG. 13 is a side elevational view of the compliance mechanism shown in FIG. 12.

The compliance mechanism 200 shown in FIGS. 12 and 13 has an L-shaped bracket 205 having a first leg 207 and a second leg 209. The first and second legs 207 and 209 are positioned substantially perpendicular to one another. The first and second legs are formed of a U-shaped channel having a base 211 and opposed side walls 213 that extend from the base 211. The side walls 213 are usually disposed so they are in substantially parallel relationship. A first slide mechanism 219 such as a linear ball bearing is secured to the base 211 of the first leg 207. A second slide mechanism 220 is secured to the base 211 of the second leg 209. A first fluid operated cylinder 222 is secured to the first slide mechanism 219 in the first leg 207. A second fluid operated cylinder 225 is positioned on the second slide mechanism 220 positioned in the second leg 209. The first and second fluid operated cylinders 222 and 225 are dual acting cylinders with supply ports 227 located on each end of the cylinders. The first and second fluid operated cylinders 222 and 225 and the slide mechanisms 219,220 function as previously described in this patent application. Slots 231 are positioned in at least one of the side walls of the first and second U-shaped legs 207 and 209 to provide access to the fluid supply ports 227. A piston rod 229 is connected to each piston and extends from a first end of each cylinder. The end of the piston rod that extends from the cylinder is secured to a plate 235 positioned at one end of the first and second legs 207 and 209. A cover plate 241 is secured to the first fluid operated cylinder and the cover plate 241 is designed to close the open side of the first U-shaped leg 207. The cover plate 241 is designed so that it can move along the first leg 207 as the first slide mechanism and first fluid operated cylinder is caused to move within the first leg 207. A fluid dispenser 247 having a fluid applicator tip 249 is secured to the cover plate 241. The second cylinder 225 of the compliance mechanism 200 is mounted to appropriate support structure as previously described in this patent application. An opening 245 can be positioned in the base 211 of the second leg 209 adjacent the first leg 207 to act as a drain for any undesirable material that might accumulate in the second leg 209. In addition, a flexible cover, not shown, can be positioned over the open side of the second U-shaped leg 209 to prevent unwanted contaminants from accumulating in the second leg. The compliance mechanism 200, shown in FIGS. 12 and 13 functions in substantially the same manner as the previously described compliance mechanism 10.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A compliance mechanism to maintain a fluid applicator in contact with the surface of an object to which a fluid is being applied comprising:

an L-shaped bracket having a first leg and a second leg;

a first tab positioned at a first end of said first leg and a second tab positioned at a first end of said second leg;

a first dual acting fluid operated cylinder slidably positioned on said first leg of said L-shaped bracket, said first cylinder having a first piston rod that extends from said first cylinder, said fluid actuation of said cylinder causing said first piston rod to be advanced relative to said first cylinder, said end of said piston rod that extends from said first cylinder being secured to said first tab;

a second dual acting fluid operated cylinder slidably positioned on said second leg of said L-shaped bracket, said second cylinder having a second piston rod that extends from said second cylinder, said fluid actuation of said cylinder causing said second piston rod to be advanced relative to said second cylinder, said end of said piston rod that extends from said second cylinder being secured to said second tab; and, a fluid applicator positioned on said first cylinder for applying a fluid to said object, said first cylinder allowing said fluid applicator to move relative to said object in a first direction and said second cylinder allowing said fluid applicator to move relative to said object in a second direction whereby said fluid applicator is maintained in contact with said object during the application of said fluid to said object and whereby said fluid applicator can be advanced or retracted in said first and second directions to accommodate any changes in shape or movement of said object during the application of said fluid to said object.

2. The compliance mechanism of claim 1 wherein said first and second cylinders can be biased towards said object by having a pressure differential present in at least one of said cylinders.

3. The compliance mechanism of claim 2 wherein said pressure differential on said first and second cylinders can be great enough to effectively prevent said cylinders from moving.

4. The compliance mechanism of claim 2 wherein a linear ball bearing is used to position said first and second cylinders on said first and second legs wherein there is very little resistance to movement of said first and second cylinders.

5. The compliance mechanism of claim 2 wherein at least one self-exhausting regulator is used to supply fluid to said first and second cylinders.

6. The compliance mechanism of claim 2 wherein said first and second cylinders create a biasing force from about one (1) ounces per square inch to about twenty five (25) ounces per square inch on said fluid applicator.

7. The compliance mechanism of claim 1 wherein said compliance mechanism is operatively connected to a movable support arm for positioning said compliance mechanism relative to said object.

8. The compliance mechanism of claim 1 wherein said second dual acting cylinder is operatively connected to a movable support arm for positioning said compliance mechanism relative to said object.

9. The compliance mechanism of claim 8 wherein said second dual acting cylinder is operatively connected to a positioning plate that is disposed at an angle with respect to said second dual acting cylinder, said positioning plate being releasably secured to a positioning member on said support arm whereby said positioning plate can be rotated on said positioning member to change the position of said compliance mechanism with respect to said object to be coated.

10. The compliance mechanism of claim 9 wherein a releasable securing means secures said positioning plate to said positioning member.

11. The compliance mechanism of claim 8 wherein said second dual acting cylinder is operatively connected to a rotary actuator that can be caused to rotate to position said compliance mechanism with respect to said object that is to be coated.

12. The compliance mechanism of claim 8 wherein said second dual acting cylinder is operatively connected to a gantry mechanism, said gantry mechanism being designed to position said compliance mechanism in two planes with respect to said object that is to be coated.

13. The compliance mechanism of claim 1, including a means for moving said object relative to said fluid applicator during the application of said fluid to said object.

14. The compliance mechanism of claim 1, wherein a supply of said fluid is applied to said object.

15. A method of maintaining a fluid applicator in contact with the surface of an object to which fluid is being applied comprising:

positioning a fluid applicator on a first dual acting fluid operated cylinder, said first dual acting fluid operated cylinder being disposed for moving said fluid applicator in a first direction;

positioning said first dual acting fluid operated cylinder on a bracket;

positioning said bracket on a second dual acting fluid operated cylinder, said second dual acting fluid operated cylinder being disposed for moving said fluid applicator in a second direction, whereby said first and second dual acting fluid operated cylinders can accommodate movement of said fluid applicator to maintain said fluid applicator in contact with said object;

advancing and/or retracting said fluid applicator in said first and said second directions to accommodate any changes in shape or movement of said object during the application of said fluid to said object.

16. The method of claim 15 in which said first and second dual acting fluid operated cylinders are biased towards said object by having a pressure differential present in said first and second cylinders.

17. The method of claim 16 in which said first and second cylinders create a biasing pressure from about one (1) ounces per square inch to about twenty five (25) ounces per square inch on said fluid applicator.

18. The method of claim 15 in which said first and second cylinders are supplied fluid through at least one self-exhausting regulator.

19. The method of claim 15 in which said second dual acting fluid operated cylinder is operatively connected to a rotatable mechanism whereby the position of said fluid applicator with respect to said object can be changed.

20. The method of claim 15 wherein a linear ball bearing positions said first and second cylinders wherein there is very little resistance to movement of said first and second cylinders.

21. The method of claim 15 in which said second dual acting fluid operated cylinder is operatively mounted to a movable support arm for positioning said fluid applicator relative to said object.

22. The method of claim 21 wherein said second dual action cylinder operatively is connected to a positioning plate that is disposed at an angle with respect to said second dual acting cylinder, said positioning plate being releasably secured to a positioning member on said support arm, and rotating said positioning plate on said positioning member to change the position of said compliance mechanism with respect to said object to be coated.

23. The method of claim 22 in which a securing means secures said positioning plate to said positioning member.

24. The method of claim 21 in which said compliance mechanism is operatively connected to a gantry mechanism, and positioning said compliance mechanism with said gantry mechanism in two planes with respect to said object that is to be coated.

25. The method of claim 15, including moving said object relative to said fluid applicator during the application of said fluid to said object.

26. The method of claim 15, including applying a continuous supply of said fluid to said object.

27. A compliance mechanism to maintain a device in contact with the surface of an object comprising:

a bracket having a first leg and a second leg;

a first dual acting fluid operated cylinder slidably positioned on said first leg of said bracket, said first cylinder having a first piston rod that extends from said first cylinder, said fluid actuation of said cylinder causing said first piston rod to be advanced relative to said first cylinder; said end of said piston rod that extends from said first cylinder being secured to said bracket;

a second dual acting fluid operated cylinder slidably positioned on said second leg of said bracket, said second cylinder having a second piston rod that extends from said second cylinder, said fluid actuation of said cylinder causing said second piston rod to be advanced relative to said second cylinder, said end of said piston rod that extends from said second cylinder being secured to said bracket; and, a device positioned on said first cylinder for contacting said object, said first cylinder allowing said device to move in a first direction and said second cylinder allowing said device to move in a second direction whereby said first and second fluid operated cylinders can accommodate movement of said device to maintain said device in contact with said object and whereby said device can be advanced or retracted in said first and said second directions to accommodate any changes in shape or movement of said object.

28. The compliance mechanism of claim 27 wherein said first and second cylinders can be biased towards said object by having a pressure differential present in one of said cylinders.

29. The compliance mechanism of claim 28 wherein a linear ball bearing is used to position said first and second cylinders on said first and second legs wherein there is very little resistance to movement of said first and second cylinders.

30. The compliance mechanism of claim 27 wherein said first and second cylinders create a biasing force from about one (1) ounces per square inch to about twenty five (25) ounces per square inch on said fluid applicator.

31. The compliance mechanism of claim 27 wherein at least one self-exhausting regulator is used to supply fluid to said first and second cylinders.

32. The compliance mechanism of claim 27 wherein said second dual acting cylinder is operatively connected to a movable support arm for positioning said compliance mechanism relative to said object.

33. The compliance mechanism of claim 32 wherein said second dual acting cylinder is operatively connected to a positioning plate that is disposed at an angle with respect to said second dual acting cylinder, said positioning plate being releasably secured to a positioning member on said support arm whereby said positioning plate can be rotated on said positioning member to change the position of said compliance mechanism with respect to said object to be coated.

34. The compliance mechanism of claim 33 wherein a releasable securing means secures said positioning plate to said positioning member.

35. The compliance mechanism of claim 27, including a means for moving said object relative to said device.

36. A compliance mechanism to maintain a device in contact with the surface of an object comprising:

a bracket having at least a first leg;

a first dual acting fluid operated cylinder slidably positioned on said leg of said bracket, said first cylinder having a first piston rod that extends from said first cylinder, said fluid actuation of said cylinder causing said first piston rod to be advanced relative to said first cylinder; said end of said piston rod that extends from said first cylinder being secured to said bracket;

a device positioned on said first cylinder for contacting said object, said first cylinder allowing said device to move in a first direction and in a second direction whereby said first fluid operated cylinder can accommodate movement of said device to maintain said device in contact with said object and whereby said device can be advanced or retracted in said first and said second directions to accommodate any changes in shape or movement of said object.

37. The compliance mechanism of claim 36 wherein said bracket has a first leg and a second leg, said first fluid operated cylinder being slidably positioned on said first leg.

38. The compliance mechanism of claim 37 wherein a second dual acting fluid operated cylinder is slidably positioned on said second leg of said bracket, said second cylinder having a second piston rod that extends from said second cylinder, said fluid actuation of said second cylinder causing said second piston rod to be advanced relative to said second cylinder, said end of said piston rod that extends from said second cylinder being secured to said bracket, whereby said second fluid operated cylinder allows said device to move relative to said object in a second direction.

39. The compliance mechanism of claim 38 wherein at least one of said first and second cylinders can be biased towards said object by having a pressure differential present in at least one of said cylinders.

40. The compliance mechanism of claim 39 wherein at least one self-exhausting regulator is used to supply fluid to said first cylinder.

41. The compliance mechanism of claim 38 wherein a linear ball bearing is used to position said first and second cylinders on said first and second legs wherein there is very little resistance to movement of said first and second cylinders.

42. The compliance mechanism of claim 36, including a means for moving said object relative to said device.

* * * * *